US012320071B2

(12) United States Patent
Hietaniemi et al.

(10) Patent No.: US 12,320,071 B2
(45) Date of Patent: Jun. 3, 2025

(54) COMPOSITION AND ITS USE FOR USE IN MANUFACTURE OF PAPER, BOARD OR THE LIKE

(71) Applicant: Kemira Oyj, Helsinki (FI)

(72) Inventors: Matti Hietaniemi, Espoo (FI); Asko Karppi, Espoo (FI)

(73) Assignee: Kemira Oyj, Helsinki (FI)

( * ) Notice: Subject to any disclaimer, the term of this patent is extended or adjusted under 35 U.S.C. 154(b) by 301 days.

(21) Appl. No.: 17/786,181

(22) PCT Filed: Dec. 18, 2020

(86) PCT No.: PCT/FI2020/050855

§ 371 (c)(1),
(2) Date: Jun. 16, 2022

(87) PCT Pub. No.: WO2021/130411

PCT Pub. Date: Jul. 1, 2021

(65) Prior Publication Data

US 2023/0024255 A1 Jan. 26, 2023

(30) Foreign Application Priority Data

Dec. 23, 2019 (FI) ..... 20196124

(51) Int. Cl.

| | |
|---|---|
| ***D21H 17/45*** | (2006.01) |
| ***D21H 11/02*** | (2006.01) |
| ***D21H 11/14*** | (2006.01) |
| ***D21H 17/28*** | (2006.01) |
| ***D21H 21/10*** | (2006.01) |
| ***D21H 21/18*** | (2006.01) |

(52) U.S. Cl.

CPC ..... *D21H 17/455* (2013.01); *D21H 11/02* (2013.01); *D21H 11/14* (2013.01); *D21H 17/28* (2013.01); *D21H 21/10* (2013.01); *D21H 21/18* (2013.01)

(58) Field of Classification Search

CPC ..... D21H 17/455; D21H 11/02; D21H 11/14; D21H 17/28; D21H 21/10; D21H 21/18; D21H 17/29; D21H 17/375

See application file for complete search history.

(56) References Cited

U.S. PATENT DOCUMENTS

| | | | | |
|---|---|---|---|---|
| 4,066,495 | A * | 1/1978 | Voigt | D21H 17/29 162/168.3 |
| 6,033,525 | A * | 3/2000 | Moffett | C08L 3/08 525/54.24 |
| 8,242,215 | B2 | 8/2012 | Hund et al. | |
| 9,809,930 | B2 * | 11/2017 | Karppi | C08L 3/08 |
| 10,844,542 | B2 * | 11/2020 | Hietaniemi | D21H 17/34 |
| 11,365,517 | B2 * | 6/2022 | Hietaniemi | D21H 21/18 |
| 11,655,593 | B2 * | 5/2023 | Hietaniemi | D21H 17/55 162/100 |
| 2004/0170749 | A1 * | 9/2004 | Neivandt | C08L 3/02 426/658 |
| 2008/0004405 | A1 * | 1/2008 | Mori | C08B 31/10 525/451 |
| 2010/0179248 | A1 | 7/2010 | Esser et al. | |
| 2010/0230063 | A1 | 9/2010 | Wielema et al. | |
| 2011/0263796 | A1 | 10/2011 | Hund et al. | |
| 2012/0118523 | A1 * | 5/2012 | Lu | D21H 21/18 524/52 |
| 2015/0068697 | A1 * | 3/2015 | Karppi | D21H 17/56 162/164.3 |
| 2016/0145810 | A1 * | 5/2016 | Miller, IV | D21F 11/006 162/111 |
| 2016/0273166 | A1 * | 9/2016 | Karppi | D21H 17/29 |
| 2016/0289896 | A1 * | 10/2016 | Hietaniemi | D21H 17/29 |
| 2017/0284028 | A1 * | 10/2017 | Hietaniemi | D21H 11/14 |
| 2023/0024255 | A1 * | 1/2023 | Hietaniemi | D21H 17/375 |
| 2024/0093433 | A1 * | 3/2024 | Hietaniemi | D21H 17/29 |

FOREIGN PATENT DOCUMENTS

| | | | | |
|---|---|---|---|---|
| CN | 106930142 | A2 | 7/2017 | |
| CN | 104781470 | B * | 8/2017 | C08B 31/00 |
| EP | 2920363 | B1 * | 9/2017 | C08B 31/00 |
| WO | WO-9806898 | A1 * | 2/1998 | C08F 220/56 |
| WO | WO-2014076372 | A1 * | 5/2014 | C08B 31/00 |
| WO | 2017114478 | A1 | 7/2017 | |
| WO | 2017149200 | A1 | 9/2017 | |
| WO | WO-2017162920 | A1 * | 9/2017 | D21H 17/29 |
| WO | WO-2018055239 | A1 * | 3/2018 | D21H 17/29 |
| WO | WO-2018109279 | A1 * | 6/2018 | C08F 220/56 |
| WO | WO-2019086761 | A1 * | 5/2019 | D21H 17/16 |

(Continued)

OTHER PUBLICATIONS

Chinese search report and English translation thereof related to corresponding patent application 2020800890416, dated on Mar. 29, 2023; 5 pages.

Ji, Zhili & Yu, Long & Liu, Hongsheng & Bao, Xianyang & Wang, Yanfei & Chen, Ling. (2017). Effect of pressure with shear stress on gelatinization of starches with different amylose/amylopectin ratios. Food Hydrocolloids. 72. 331-337. 10.1016/j.foodhyd.2017.06.015.

International Search Report and Written Opinion in International Application No. PCT/FI2020/050855, mailed on Mar. 15, 2021, 13 pages.

*Primary Examiner* — Jose A Fortuna

(74) *Attorney, Agent, or Firm* — Meunier Carlin & Curfman LLC

(57) ABSTRACT

The invention relates to a composition for use in a manufacture of paper, board or the like. The composition comprises a mixture of cationic starch having amylopectin content of at least 85%, and an amphoteric polymeric structure comprising structural units originating from non-ionic monomers, preferably (meth)acrylamide, anionic groups and cationic groups, the polymeric structure comprising cationic groups at least 0.2 mol-%.

13 Claims, No Drawings

(56) References Cited

FOREIGN PATENT DOCUMENTS

| | | | | |
|---|---|---|---|---|
| WO | WO-2019180302 A1 * | 9/2019 | ..... | D21F 11/00 |
| WO | WO-2021130411 A1 * | 7/2021 | ..... | D21H 11/02 |

* cited by examiner

COMPOSITION AND ITS USE FOR USE IN MANUFACTURE OF PAPER, BOARD OR THE LIKE

CROSS REFERENCE TO RELATED APPLICATIONS

This application is a United States National Phase patent application of International Patent Application Number PCT/FI2020/050855, filed on Dec. 18, 2020, which claims the benefit of priority to Finnish National Patent Application number FI 20196124, filed on Dec. 23, 2019, both of which are incorporated by reference herein in their entireties

FIELD OF THE INVENTION

The present invention relates to a composition for use in manufacture of paper, board or the like according to the preambles of the enclosed independent claims.

BACKGROUND OF THE INVENTION

In manufacture of paper or board the properties of the fibre stock as well as the final paper are modified by adding various chemicals to the fibre stock before the formation of the paper or board web. Synthetic cationic polymers are commonly used in papermaking to increase, for example, the dry strength properties of the final paper or board. The cationic polymers are added to the fibre stock where they interact with the components of the stock, e.g. fibres and/or fillers.

Very often cationic synthetic polymers, which are used as strength agents, are obtained by solution polymerisation and are available only as solutions. For dry strength purposes the average molecular weight of the polymers should preferably be as high as possible. The molecular weight of the solution polymers is, however, limited due to the viscosity: as the molecular weight increases the viscosity of the polymer solution increases and makes it unsuitable for industrial applications. In addition, solution polymers may have challenges with transportation costs, shelf-life and microbial resistance.

There is an increasing demand for board, especially containerboard, as packaging material due to global commerce and online retail. The board for packaging should have good strength properties, especially SCT and burst strength. There is a demand to improve the strength characteristics of the linerboard, particularly characteristics of testliner made of recycled fibres with lower strength characteristics. The strength agents provided should, however, be easy and inexpensive to use as the containerboard is a bulk product, where the end price of the product is one of the decisive factors. Consequently, there is a constant need to find new effective and inexpensive strength agents, especially for board.

SUMMARY OF THE INVENTION

An object of this invention is to minimise or even eliminate the disadvantages existing in the prior art.

An object is also to provide a composition which provides an effective increase in dry strength properties of the final paper or board.

These objects are attained with the invention having the characteristics presented below in the characterising parts of the independent claims. Some preferable embodiments are disclosed in the dependent claims.

The embodiments mentioned in this text relate, where applicable, to all aspects of the invention, even if this is not always separately mentioned.

A typical composition according to the present invention for use in manufacture of paper, board or the like, comprising a mixture of

- cationic starch having amylopectin content of at least 85%, and
- an amphoteric polymeric structure comprising structural units originating from non-ionic monomers, preferably (meth)acrylamide, anionic groups and cationic groups, the polymeric structure comprising cationic groups at least 0.2 mol-%.

Typical use according to the present invention of the composition according to the invention is as a strength agent, drainage agent, fixative or retention agent in manufacture of paper, board, tissue or the like.

DETAILED DESCRIPTION OF THE INVENTION

Now it has been surprisingly found that a composition comprising cationic high amylopectin starch and an amphoteric polymer provides an improved strength effect when added to the fibre stock. It is assumed, without wishing to be bound by a theory, that the cationic starch and the amphoteric polymeric structure create a far-reaching network which interacts with fibres and other stock constituents. The composition of the present invention can be either net anionic or net cationic, as long as the polymeric structure is amphoteric. The amphoteric polymeric structure provides an unexpected improvement for the results obtainable with the composition. It is speculated that the amphoteric nature of the polymeric structure may provide some kind of looping and/or self-complexing tendency of the amphoteric polymeric structure, which provides increased strength effect in the final paper and board. It has been observed that the bulk of the produced paper or board is simultaneously improved, i.e. increased. The concurrent improvement in both strength and bulk is unexpected and advantageous, especially with stocks which comprise recycled fibres.

The polymeric structure preferably comprises at least 0.2 mol-% of cationic groups. This means that the polymeric structure comprises at least 0.2 mol-% of structural units that contain or carry cationic charge. The structural unit may originate from a cationic monomer which have become a part of the polymeric structure in the polymerisation or the structural unit may originate from an anionic or non-ionic monomer that has been modified to become cationic. Preferably the polymeric structure comprises at least 0.2 mol-% structural units originating from cationic monomers.

The composition according to the present invention comprises a pre-formed mixture of cationic high amylopectin starch and an amphoteric polymer. In the preparation of the composition starch and the amphoteric polymer are usually first separately diluted and/or dissolved in water, whereby both of the components are in form of an aqueous solution or dispersion at the time of mixing. The cationic starch component is typically in form of an aqueous solution, which means that the starch has been dissolved in water, e.g. by cooking. The cooking may be performed at temperature of 60-135° C.

The composition may comprise cationic starch and amphoteric polymeric structure in a weight ratio from 10:90 to 75:25, preferably from 15:85 to 65:35, more preferably from 20:80 to 60:40, calculated as dry.

According to one embodiment of the invention the composition comprising cationic starch and amphoteric polymeric structure may have a net charge from +0.05 meq/g to +1.8 meq/g, preferably from +0.1 meq/g to +1.3 meq/g, more preferably from +0.2 meq/g to +1.0 meq/g, measured at pH 2.8. According to one embodiment of the invention the composition comprising cationic starch and amphoteric polymeric structure may have a net charge from −1.5 meq/g to +1.5 meq/g, preferably from −1 meq/g to +1 meq/g, more preferably from −0.8 meq/g to +0.8 meq/g, sometimes even more preferably from −0.15 meq/g to +0.8 meq/g, when measured at pH 7. In an embodiment the composition may have a net charge from −1.5 meq/g to +0.9 meq/g, preferably from −1 meq/g to +0.5 meq/g, when measured at pH 7. The defined charge density at pH 2.8 is suitable to provide easy handling of the composition, and at pH 7 the charge density is sufficient to ensure the presence of anionic charges in order to provide desired self-looping tendency and effective interaction with starch.

The composition of the present invention comprising cationic starch and amphoteric polymeric structure may have a net cationic charge at pH 7. The composition may have a charge density which is less than +1 meq/g, for example in a range from +0.01 meq/g to +0.9 meq/g. It has been observed that compositions with net cationic charge are especially suitable for fibre stock comprising recycled fibres. When the composition is net cationic at pH 7, it may preferably have a cationic net charge from 0.4 meq/g to 1.8 meq/g, more preferably from 0.5 meq/g to 1.3 meq/g, at pH 2.8. When the composition is net cationic, the cationic groups of the composition can effectively interact with the negatively charged surfaces of the fibres present in the fibre stock.

Alternatively, according to another embodiment the composition of the present invention may be net anionic. The net anionic composition comprising cationic starch and amphoteric polymeric structure may have a charge density in the range from −1.5 meg/g to −0.01 meg/g, preferably from −1.5 meq/g to −0.1 meq/g, more preferably from −1 meq/g to −0.1 meq/g, sometimes even more preferably from −0.8 meq/g to −0.15 meq/g, at pH 7. When the composition is net anionic at pH 7, it may preferably have charge density from 0.05 meq/g to 0.4 meq/g, more preferably from 0.1 meq/g to 0.3 meq/g, at pH 2.8. When the composition is net anionic, it is assumed that the cationic groups of the composition cause self-looping and disturb the linearity of the polymeric structure. It has been observed that compositions with net anionic charge are especially suitable for making of board, especially chemi-thermomechanical (CTMP) fibres.

The composition comprises typically cationic starch having amylopectin content of at least 85%. High amylopectin starch is preferable as it provides a branched network structure that improves the interaction of the composition with fibres, fillers and other stock constituents. According to one embodiment the cationic starch may have an amylopectin content of >90%, preferably >95%, more preferably >98%. Amylopectin content of commercial starches are commonly provided by the starch manufacturers.

If needed, the amylopectin content may be determined by using the iodine-binding method disclosed by Zhili Ji et al. in Food Hydrocolloids 72 (2017) 331-337, under 2.1. The cationic starch may be tapioca starch, waxy corn starch, waxy potato starch or any of their mixtures.

The starch is dissolved or solubilized in water by any suitable method known as such for the person skilled in the art, e.g. by cooking. The starch suitable for use in the present invention is thus in form of aqueous solution, where the starch is in form of molecular dispersion in aqueous phase. The starch solution is preferably free of starch granules or starch particles.

According to one preferable embodiment the composition comprises cationic starch, which is non-degraded starch. In the present context the term "non-degraded starch" denotes starch which is essentially untreated by oxidative, thermal, enzymatical and/or acid treatment in a manner that would cause hydrolysis of glycosidic bonds or degradation of starch molecules or units. In case the starch is solubilized by cooking, the temperature during cooking is less than 140° C., preferably less than 120° C., often less than 110° C. or 105° C.

Starch viscosity is an indication of its non-degradability. For example, after solubilisation the non-degraded cationic starch has a viscosity at least of 20% preferably at least 50% of a viscosity of a corresponding native starch, solubilized by cooking at 97° C. at 2% solids for 30 min. The viscosity measurement is made by Brookfield LV-DVI viscometer, at 2% solids content and at room temperature.

The cationic starch used for the composition may have a substitution degree of 0.02-0.25, preferably 0.03-0.20, more preferably 0.035-0.15, even more preferably 0.05-0.1, sometimes even 0.05-0.97 or 0.07-0.97. The substitution degree is relative to the cationicity of the starch. Starch may be cationised by any suitable method. Preferably starch is cationised by using 2,3-epoxypropyltrimethylammonium chloride or 3-chloro-2-hydroxypropyltrimethylammonium chloride, 2,3-epoxypropyltrimethylammonium chloride being preferred. It is also possible to cationise starch by using cationic acrylamide derivatives, such as (3-acrylamidopropyl)-trimethylammonium chloride. It has been observed that the cationic starch having the described substitution degree adsorb well onto the fibres. As the starch is preferably non-degraded, the degree of substitution together with the high molecular weight provide a far-reaching network that effectively can interact with the fibres.

According to one preferable embodiment the composition comprises an amphoteric polymeric structure obtained by polymerisation of non-ionic monomers, preferably (meth) acrylamide, and at least one anionic monomer and at least one cationic monomer. The amphoteric polymeric structure may be a copolymer of non-ionic, cationic and anionic monomers.

Alternatively, the amphoteric polymeric structure may be obtained by polymerisation of one or more of non-ionic, cationic and/or anionic monomers, and by subsequent modification at least part of the structural units of the resulting polymeric structure originating from said monomer(s), wherein they become charged (anionic/cationic) groups. For example, cationic groups may be generated to the polymeric structure by modification of an existing unit originating from a non-ionic and/or an anionic monomer. Examples of such modifications include post-polymerisation hydrolysis of a non-ionic group, such as formamide group, and/or derivatisation of an anionic group, such as carboxyl group, into a cationic group. In analogous manner, anionic groups may be generated to the polymeric structure for example by modification of an existing unit originating from a cationic and/or a non-ionic monomer. Further examples of such modifications include post-polymerisation hydrolysis of a cationic group, such as cationic ester group, and/or hydrolysis of a non-ionic group, such as amide group, into an anionic group. Other examples include derivatisation of e.g. a non-ionic group, such as amide group, into an anionic group. As understood by a person skilled in the art, these well-known approaches may result in amphoteric polymeric structures having essentially the same characteristics as the amphoteric polymeric structures obtained by polymerisation of non-ionic, cationic and anionic monomers, and thus being equally usable in the present invention.

According to one preferable embodiment the cationic groups in the amphoteric polymeric structure may be derived from Hofmann degradation reaction of acrylamide, where at least a part of the amide functions of the acrylamide are converted into amine functions. Hofmann degradation reaction is known as such for a person skilled in the art.

The polymeric structure is preferably obtained by gel polymerisation. Alternatively, the amphoteric polymeric structure may be obtained by polymerising charged monomers, either anionic or cationic, in a polymerisation medium comprising a polymer, which is oppositely charged. In this manner the amphoteric polymeric structure comprises an anionic and cationic polymer chains that are irrevocably interlaced with each other in form of an interpenetrating networks of oppositely charged polymers.

According to one embodiment the composition comprises a linear amphoteric polymeric structure, i.e. the polymeric structure in non-crosslinked or non-branched, preferably non-crosslinked and non-branched. As the amphoteric polymeric structure is both self-looping and forms complexes with the cationic starch, the effective interaction with fibres can be obtained without any extensive branching.

Preferably the amphoteric polymeric structure is in form of dry particulate material before it is dissolved and mixed with cationic high amylopectin starch solution.

The amphoteric polymeric structure may have a net charge from −2 meq/g to +2 meq/g, preferably from −1.4 meq/g to +1.5 meq/g, more preferably from −1 meq/g to +1 meq/g, measured at pH 7. Sometimes the amphoteric polymeric structure may have a net charge the from −2 meq/g to +0.9 meq/g from −1 meq/g to +0.9 meq/g, measured at pH 7. The amphoteric polymeric structure may be net anionic or net cationic, preferably the amphoteric polymeric structure may have a net cationic charge. The net charge may be, for example from +0.01 meq/g to +1 meq/g or from +0.01 meq/g to +0.9 meq/g. The amphoteric polymeric structure thus comprises both cationically charged and anionically charged structural units, e.g. pendant groups. The presence of oppositely charged groups may provide self-looping of the polymeric structure, i.e. the charged groups of one polymeric structure may form ionic bonds with each other. The possibility for self-looping of the polymeric structure, combined with the interactions with the network of the cationic amylopectin starch, provide surprising improvement in strength properties as well as increased bulk. Furthermore, a significant improvement in ash retention may be obtained, which indicates that the overall network created by high amylopectin starch and the amphoteric polymeric structure effectively interacts and retains filler particles to the formed web. Preferably, the net charge of the amphoteric polymeric structure is moderate, as described above, in order to avoid excess self-looping of the structure.

The amphoteric polymeric structure comprises structural units originating from non-ionic monomers. If the amphoteric polymeric structure is obtained by free radical copolymerisation of non-ionic, cationic and anionic monomers, the non-ionic monomer may preferably be selected from acrylamide and methacrylamide. If the amphoteric polymeric structure is obtained by polymerising non-ionic and charged monomers in a polymerisation medium comprising an oppositely charged polymer, the non-ionic monomer may preferably be selected from acrylamide or methacrylamide.

According to one embodiment the polymeric structure may comprises 0.2-40 mol-%, preferably 0.5-10 mol-%, more preferably 1-8 mol-%, of cationic groups, originating e.g. from cationic monomers, and/or 0.2-20 mol-%, preferably 0.5-10 mol-%, more preferably 1-8 mol-%, of anionic groups, originating e.g. from anionic monomers. The polymeric structure has either a net anionic or cationic character, which means that the ratio of the anionic groups and cationic groups is not 1:1. For example, the ratio of the anionic groups to cationic groups may be 1:1.5 or 1.5:1. The anionic groups of the polymeric structure are mainly interacting with the cationic starch component of the composition.

The amphoteric polymeric structure may be obtained by polymerisation of non-ionic monomers, optional cationic monomers and 0.5-15 mol-%, preferably 0.7-12 mol-%, more preferably 1-9 mol-%, of anionic monomers. The anionic monomers may be selected from acrylic acid, methacrylic acid, maleic acid, itaconic acid, crotonic acid, isocrotonic acid, sulfonic acid, 2-acrylamide-2-methylpropane sulfonic acid, allylmethylsulfonate and any of their mixtures, and their salts.

The amphoteric polymeric structure may be obtained by polymerisation of non-ionic monomers, optional anionic monomers and 0.4-19 mol-%, preferably 1-15 mol-%, more preferably 1-10 mol-% of cationic monomers. The cationic monomers may be selected from 2-(dimethylamino)ethyl acrylate (ADAM), [2-(acryloyloxy)ethyl] trimethylammonium chloride (ADAM-Cl), 2-(dimethylamino)ethyl acrylate benzylchloride, 2-(dimethylamino)ethyl acrylate dimethylsulphate, 2-dimethylaminoethyl methacrylate (MADAM), [2-(methacryloyloxy)ethyl] trimethylammonium chloride (MADAM-Cl), 2-dimethylaminoethyl methacrylate dimethylsulphate, [3-(acryloylamino)propyl] trimethylammonium chloride (APTAC), [3-(methacryloylamino)propyl] trimethylammonium chloride (MAPTAC), and diallyldimethylammonium chloride (DADMAC), and any of their mixtures.

According to one embodiment of the amphoteric polymeric structure MW has a weight average molecular weight MW in the range of 400 000-10 000 000 Da, preferably 1 000 000-7 000 000 Da, more preferably 2 000 000-5 000 000 Da, sometimes even more preferably 2 000 000-4 500 000 Da.

The composition may be added to a fibre slurry or fibre stock in amount of 0.3-5 kg/t dry paper, preferably 1-4 kg/t dry paper. According to one preferable embodiment the fibre slurry comprises recycled fibres.

The composition is added to the thick stock or thin stock, preferably thick stock.

EXPERIMENTAL

Application Experiments

Application examples 1-2 provide information about the behaviour and effect of different dry strength compositions according to the invention comprising amphoteric polymeric structures. Table 1 gives methods and standards used for pulp characterisation and sheet testing in the application experiments.

TABLE 1

Standards and methods used for pulp characterisation and sheet testing in application examples.

| Property | Device/ | Standard |
|---|---|---|
| pH | Knick Portamess 911 | — |
| Conductivity (mS/cm) | Knick Portamess 911 | — |
| Zeta potential (mV) | Mütek SZP-06 | — |
| Consistency (g/l) | — | ISO 4119 |
| Basis weight | Mettler Toledo | ISO 536 |
| Thickness, bulk | Lorentzen & Wettre | ISO 534 |
| Ash content, 525° C. | — | ISO 1762 |
| Short span compression test (SCT) | Lorentzen & Wettre | ISO 9895 |
| Concora medium test, 30 min (CMT) | IDM test, PTA Group | ISO 7263: 1994 |
| Burst strength | IDM test, PTA Group | ISO 2758 |
| Ring crush test (RCT) | IDM test, PTA Group | Tappi T 822 om-02 |

Application Example 1

Application example 1 simulates preparation of testliner and fluting. Test sheets are made with Rapid Köthen type sheet former.

Test fibre stock is made from 50% of dry testliner and 50% of fluting originating from Germany, produced from 100% recycled fibres. Ash content of furnish is 16%. Test pulp is disintegrated according to ISO 5263:1995, at 70° C. Test fibre stock is diluted to 0.6% consistency with deionized water, pH adjusted to 7, and conductivity is adjusted to 3 mS/cm with a salt mixture containing 70% calcium acetate, 20% sodium sulphate and 10% sodium bicarbonate. The same salt mixture is added to obtain 3 mS conductivity for water to fill hand sheet machine dilution water tank to 4 liters. Zeta potential of used test fibre stock is −6.5 mV.

Following chemicals are used in the Application Example 1:

EXPN45: a composition prepared by mixing solutions of waxy starch and amphoteric polymeric structure in 50:50 dry weight ratio. Waxy starch (amylopectin content >98%) is cationic, degree of substitution 0.055, starch solution cooked at 1 weight-% concentration at 97° C. for 60 min. Amphoteric polymeric structure of 2 mol-% of anionic monomers (acrylic acid), 7 mol-% of cationic monomers ([2-(acryloyloxy)ethyl] trimethylammonium chloride) and 91 mol-% of non-ionic monomers (acrylamide), having linear structure and weight average molecular weight of 4 MDa, dissolved to 0.8 weight-% concentration, pH adjusted to 3.5 before mixing to waxy starch. Mixing was completed in a beaker with propeller mixer at least for 1 hour until the mixture was homogeneous.

CPAM: Fennopol K 3500P (cationic polyacrylamide, Kemira Oyj), dissolved at 0.5 weight-%, diluted to 0.05 weight-% concentration.

silica microparticle: FennoSil 2180 (structured aluminized silica, Kemira Oyj), diluted to 0.1 weight-%.

Sheet Formation:

Handsheets having basis weight of 110 g/m$^2$ are formed by using Rapid Köthen sheet former, according to ISO 5269-2:2012. Chemicals are mixed to the fibre stock in a dynamic drainage jar, at 1000 rpm propeller speed for 60 s before pouring to a sheet former. Added retention aid CPAM is dosed to pulp mixture 15 s before sheet forming. Retention aid CPAM dosage in test 1 is 400 g/t. Basis weight and retention are kept constant in other test points by adjusting the retention aid dosage. Added retention silica microparticle is dosed to pulp mixture 10 s before sheet forming. The silica microparticle dosage is 400 g/t. The handsheets are dried in vacuum dryers for 6 minutes at 92° C., at 1000 mbar. Before testing in the laboratory, the sheets are pre-conditioned for 24 h at 23° C. in 50% relative humidity, according to ISO 187.

Results are shown in Table 2. The index values are obtained by dividing the obtained strength value by the basis weight of the prepared sheet.

TABLE 2

Results of application example 1.

| | Time, s | | | | | | |
|---|---|---|---|---|---|---|---|
| Test | −60 EXPN45 [kg/t dry] | −15 CPAM [kg/t dry] | −10 silica microparticle [kg/t dry] | Zeta potential [mV] | SCT index [Nm/g] | CMT index [Nm$^2$/g] | Burst index [kPam$^2$/g] |
| 1 | 0 | 0.4 | 0.4 | −6.7 | 19 | 0.85 | 1.9 |
| 2 | 1 | 0.1 | 0.4 | −4.5 | 20 | 0.86 | 2.1 |
| 3 | 2 | 0.05 | 0.4 | −2.4 | 21 | 0.90 | 2.0 |

It is seen from Table 2 that the strength composition comprising cationic starch with amylopectin content of >98% and amphoteric polymeric structure seems to be effectively adsorbed by fibre stock due to increased Zeta-potential value. It is further seen that the important strength properties for testliner, such as SCT and burst strength, are increasing. Furthermore, an additional important strength property especially for fluting, namely SCT, show an increasing trend. At the same time the consumption of the retention aid decreases significantly, which indicate possible savings in overall chemical consumption without deterioration of the obtained properties.

Application Example 2

Application Example 2 simulates preparation of testliner and fluting. Test sheets are made with Formette-dynamic hand sheet former manufactured by Techpap.

Test fibre stock is made from dry test liner originated from the United States, produced from 100% old corrugated container pulp, OCC. Ash content of the test fibre stock is 7%. Test pulp is disintegrated according to ISO 5263:1995, at 70° C. Test fibre stock is diluted to 0.6% consistency with deionized water, pH adjusted to 7, and conductivity is adjusted to 4 mS/cm with a salt mixture containing 70% calcium acetate, 20% sodium sulphate and 10% sodium bicarbonate. The same salt mixture is added to obtain 4 mS conductivity for water to fill drum of Formette with 8 liter for the preparation of each sheet.

Following chemicals are used in the Application Example 2:

REFMIX: a composition prepared by mixing solutions of cationic polyacrylamide and waxy starch in 50:50 dry weight ratio. Waxy starch (amylopectin content >98%) is cationic, degree of substitution 0.055, starch solution cooked at 1 weight-% concentration at 97° C. for 60 min. The cationic polyacrylamide contains 10 mol-% of cationic monomers, has a weight average molecular weight of 1 MD, pH adjusted to 4 before mixing of waxy starch. Mixing was completed in a beaker with propeller mixer at least for 1 hour until the mixture was homogeneous.

EXPN45: as in application example 1

EXPN45d2: a composition prepared by mixing solutions of waxy starch and amphoteric polymeric structure in 50:50 dry weight ratio. Waxy starch (amylopectin content >98%) is cationic, degree of substitution 0.055, starch solution cooked at 1 weight-% concentration at 97° C. for 60 min. Amphoteric polymeric structure of 2 mol-% of anionic monomers (acrylic acid), 7 mol-% of cationic monomers ([2-(acryloyloxy)ethyl] trimethylammonium chloride) and 91 mol-% of non-ionic monomers (acrylamide), having linear structure and weight average molecular weight of 1 MDa, dissolved to 0.8 weight-% concentration, pH adjusted to 3.5 before mixing to waxy starch. Mixing was completed in a beaker with propeller mixer at least for 1 hour until the mixture was homogeneous.

CPAM: as in application example 1.

silica microparticle: as in application example 1.

Consequently, in the application test 2 the composition EXPN45 comprises an amphoteric polymeric structure with higher molecular weight (4 MDa) and the composition EXPNd2 comprises an amphoteric polymeric structure with lower molecular weight (1 MDa). Reference composition REFMIX comprises a cationic polymer instead of any amphoteric polymeric structure.

Sheet Formation:

Pulp mixture is added to Formette to obtain 110 g/m$^2$ basis weight. Chemical additions are made to the mixing tank of Formette according to Table 3. All chemical amounts are given as kg dry chemical per ton dry fibre stock. Water is drained out after all the pulp is sprayed. Drum is operated with 1400 rpm, mixer for pulp and chemicals preparation 650 rpm and 200 rpm for sheet spraying, pulp pump 1100 rpm, number of sweeps until all material is sprayed and scoop time 60 s. Added retention aid CPAM is dosed in amount of 400 g/t pulp mixture 15 s before spraying. Added retention silica microparticle is dosed in amount of 400 g/t pulp mixture 10 s before sheet spraying. Sheet is removed from drum between wire and 1 blotting paper on the other side of the sheet. Wetted blotting paper and wire are removed. Sheets are wet pressed (Techpap nip press) with 9 bar pressure with 2 passes having new blotting paper each side of the sheet. Before first pass wetted paper machine felts are used both sides in contact with press nip rolls. Sheets are dried in STFI restrained dryer at 130° C. for 10 min. Before testing in the laboratory, the sheets are pre-conditioned for 24 h at 23° C. in 50% relative humidity, according to ISO 187.

The chemical additions made to the mixing tank of Formette are shown in Table 3.

TABLE 3

Chemical additions to the mixing tank of Formette in application example 2.

| | Time, s | | | | |
|---|---|---|---|---|---|
| Test | −60 REFMIX [kg/t dry] | −60 EXPN45 [kg/t dry] | −60 EXPN45d2 [kg/t dry] | −15 CPAM [kg/t dry] | −10 silica microparticle [kg/t dry] |
| 1 (0-test) | — | — | — | 0.4 | 0.4 |
| 2 (reference) | 1.8 | — | — | 0.4 | 0.4 |
| 3 | — | 1.8 | — | 0.4 | 0.4 |
| 4 | — | — | 1.8 | 0.4 | 0.4 |
| 5 | — | — | 2.2 | 0.4 | 0.4 |

The results of application example 2 are shown in Table 4.

TABLE 4

Results of application example 2.

| Test | Ash Content [%] | SCT index CD [Nm/g] | Burst index [kPam$^2$/g] | CMT index MD [Nm$^2$/g] | Ring Crush Test index CD [Nm/g] |
|---|---|---|---|---|---|
| 1 | 11 | 15.0 | 2.32 | 1.11 | 6.7 |
| 2 | 11 | 15.4 | 2.38 | 1.16 | 7.4 |
| 3 | 12 | 15.6 | 2.46 | 1.23 | 7.6 |
| 4 | 11 | NA | 2.44 | 1.29 | 7.4 |
| 5 | 11 | NA | 2.44 | 1.27 | 7.7 |

CD = cross direction
MD = machine direction

It is seen that the test 3 and 4, which are according to the invention, show improved burst strength and CMT strength values in comparison to the reference composition used in test 2. Test 3 improves also ash retention, as well as SCT and RCT values in comparison to reference test 5. It is seen that composition EXPN45d2 with lower molecular weight provides an advantage in CMT strength, which is needed for fluting. It can be further assumed, on basis of the ash content that the flocculation is less, which may be beneficial as it minimizes the disturbances in web formation.

Application Example 3

An additional series of tests is made to demonstrate the behaviour of a composition comprising a net anionic amphoteric polymeric structure and waxy starch. The same methods and procedures as in application example 2 is used.

The following composition is used:

EXPN66d2: composition prepared by mixing solutions of waxy starch and an amphoteric polymeric structure in 30:70 dry weight ratio. Waxy starch (amylopectin content >98%) is cationic, degree of substitution 0.055, starch solution cooked at 1 weight-% concentration at 97° C. for 60 min. Amphoteric polymeric structure of 6 mol-% of anionic monomers (acrylic acid), 1 mol-% of cationic monomers ([2-(acryloyloxy)ethyl] trimethylammonium chloride) and 93 mol-% of non-ionic monomers (acrylamide), having linear structure and weight average molecular weight of 1 MDa, dissolved to 0.8 weight-% concentration, pH adjusted to 3.5 before mixing to waxy starch. Mixing was completed in a beaker with propeller mixer at least for 1 hour until the mixture was homogeneous.

The chemical additions made to the mixing tank of Formette and the results of the application example 3 are shown in Table 5.

It is to be noted that composition EXPN66d2 is used as a second component of the dry strength system, and it is dosed after the cationic strength composition REFMIX (test 7 and 8).

TABLE 5

Chemical additions to the mixing tank of Formette and results of application example 3.

| | Time, s | | | | |
|---|---|---|---|---|---|
| Test | −60 REFMIX [kg/t dry] | −40 EXPN66d2 [kg/t dry] | −15 CPAM [kg/t dry] | −10 silica microparticle [kg/t dry] | CMT index MD [$Nm^2/g$] |
| 6 (0-test) | 1.8 | — | 0.4 | 0.4 | 1.16 |
| 7 | 1.8 | 1.5 | 0.4 | 0.4 | 1.20 |
| 8 | 1.8 | 2.2 | 0.4 | 0.4 | 1.25 |

It is seen that the CMT strength is clearly improved when the composition EXPN66d2 is added as second strength component to the fibre stock.

Even if the invention was described with reference to what at present seems to be the most practical and preferred embodiments, it is appreciated that the invention shall not be limited to the embodiments described above, but the invention is intended to cover also different modifications and equivalent technical solutions within the scope of the enclosed claims.

The invention claimed is:

1. A composition for use in a manufacture of paper or board, comprising a mixture of:

an aqueous solution of cationic starch having amylopectin content of at least 85% and a substitution degree of 0.05-0.25, wherein the aqueous solution is prepared by cooking; and a separately prepared aqueous solution or dispersion of an amphoteric polymeric structure comprising structural units originating from non-ionic monomers selected from acrylamide and methacrylamide, anionic groups and cationic groups, wherein the amphoteric polymeric structure comprises cationic groups in a range of 0.2-8 mol-% and has a net charge from −2 meq/g to +2 meq/g, measured at pH 7, wherein the composition comprises cationic starch and amphoteric polymeric structure in a weight ratio from 10:90 to 75:25, calculated as dry, and has a net charge from −1.5 meq/g to +1.5 meq/g, at pH 7.

2. The composition according to claim 1, wherein the amphoteric polymeric structure is obtained by polymerisation of non-ionic monomers, and at least one anionic monomer and at least one cationic monomer.

3. The composition according to claim 2, wherein the cationic monomer is selected from 2-(dimethylamino)ethyl acrylate (ADAM), [2-(acryloyloxy)ethyl] trimethylammonium chloride (ADAM-Cl), 2-(dimethylamino)ethyl acrylate benzylchloride, 2-(dimethylamino)ethyl acrylate dimethylsulphate, 2-dimethylaminoethyl methacrylate (MADAM), [2-(methacryloyloxy)ethyl] trimethylammonium chloride (MADAM-Cl), 2-dimethylaminoethyl methacrylate dimethylsulphate, [3-(acryloylamino)propyl] trimethylammonium chloride (APTAC), [3-(methacryloylamino)propyl] trimethylammonium chloride (MAPTAC), and diallyldimethylammonium chloride (DADMAC).

4. The composition according to claim 2, wherein the anionic monomer is selected from acrylic acid, methacrylic acid, maleic acid, itaconic acid, crotonic acid, isocrotonic acid, sulfonic acid, 2-acrylamido-2-methylpropane sulfonic acid, allylmethylsulfonate and any of their mixtures, or their salts.

5. The composition according to claim 1 wherein the amphoteric polymeric structure is obtained by polymerisation of non-ionic monomers and 0.4-19 mol-%, of cationic monomers.

6. The composition according to claim 1, wherein the cationic groups are derived from Hofmann degradation reaction of acrylamide.

7. The composition according to claim 1, wherein the amphoteric polymeric structure has a net charge from −1.4 meq/g to +1.5 meq/g, measured at pH 7.

8. The composition according to claim 1, wherein the amphoteric polymeric structure has a net cationic charge.

9. The composition according to claim 1, wherein the amphoteric polymeric structure is obtained by polymerisation of non-ionic monomers and 0.5-15 mol-% of anionic monomers.

10. The composition according to claim 1, wherein the composition has a net charge from +0.05 meq/g to +1.8 meq/g, measured at pH 2.8.

11. The composition according to claim 1, wherein the composition has a net charge from-1 meq/g to +1 meq/g, measured at pH 7.

12. The composition according to claim 1, wherein the cationic starch has an amylopectin content of >90%.

13. The composition according to claim 1, wherein the cationic starch is non-degraded starch and/or has a substitution degree of 0.03-0.20.

* * * * *